US005279129A

United States Patent [19]

Ito

[11] Patent Number: 5,279,129

[45] Date of Patent: Jan. 18, 1994

[54] GAS SUPPLY APPARATUS

[75] Inventor: Atsushi Ito, Yamagata, Japan

[73] Assignee: NEC Corporation, Tokyo, Japan

[21] Appl. No.: 891,804

[22] Filed: Jun. 1, 1992

[30] Foreign Application Priority Data

Jun. 7, 1991 [JP] Japan ..... 3-042683[U]

[51] Int. Cl.[5] ..... F17C 9/02

[52] U.S. Cl. ..... 62/50.2; 122/4A

[58] Field of Search ..... 62/50.2; 137/13; 122/4

[56] References Cited

U.S. PATENT DOCUMENTS 4,348,873 9/1982 Yamauchi et al. ..... 62/50.2

OTHER PUBLICATIONS

H. B. Bell et al., "Reactive Ion Etching of Aluminum/-Silicon in $BBr_3/Cl_2$ and $BCl_3/Cl_2$ Mixtures", J. Electrochem, Soc.: Solid-State Science and Technology May 1988, vol. 135, No. 5, pp. 1184–1191.

*Primary Examiner*—Edward G. Favors

*Attorney, Agent, or Firm*—Laff, Whitesel, Conte & Saret

[57] ABSTRACT

According to this invention, a gas supply apparatus includes a bomb, a mass flow controller, a valve, and a heating means. The bomb is filled with a liquid gas. The mass flow controller controls a flow rate of an evaporated gas supplied from the bomb to supply the liquid gas having a vapor pressure lower than an atmospheric pressure to a vacuum vessel evacuated at a predetermined degree of vacuum through a long pipe. A valve is arranged between the bomb and the mass flow controller and performs supply/interruption of the gas flowing into the mass flow controller. A heater heats the mass flow controller, the valve, and a pipe for connecting the mass flow controller and the valve.

5 Claims, 3 Drawing Sheets

GAS SUPPLY APPARATUS

BACKGROUND OF THE INVENTION

The present invention relates to a gas supply apparatus and, more particularly, to a gas supply apparatus for supplying a gas having a vapor pressure lower than the atmospheric pressure to a vacuum vessel which is evacuated.

FIG. 3 shows a piping system for explaining a conventional gas supply apparatus. As shown in FIG. 3, a conventional gas supply apparatus 6 includes a bomb 1 filled with a gas, a source valve 2 for performing supply/interruption of the gas, a pipe 7 connected to a vacuum device 9, a heater 13 for heating the pipe 7 and the source valve 2. The gas supply apparatus 6 supplies the gas to a vacuum vessel 10 evacuated to a predetermined pressure, e.g., 0.05 atm, in the vacuum device 9 through a mass flow controller 4 for automatically controlling a gas flow rate. Reference numeral 12 denotes a vacuum pump arranged in the vacuum device 9, and reference numerals 14 to 16 denote valves for interrupting gas.

Since the vacuum device 9 is generally separated from the gas supply apparatus in a dustproof room, the pipe 7 for supplying a liquid gas having a vapor pressure lower than the atmospheric pressure to the vacuum device 9 is set to be long. For this reason, attention must be paid to a change in temperature and temperature distribution of the pipe 7. That is, a pressure in the pipe 7 up to the mass flow controller 4*a* is relatively high, and a temperature in the pipe 7 is lower than that in the bomb 1. For this reason, gas is liquefied, and the liquid gas is filled in the pipe 7, thereby causing gas supply to be difficult. In order to prevent this, a pipe portion extending from the outlet of the bomb 1 to the mass flow controller 4 in the vacuum device main body 9 must be wound by the heater 13 such that the temperature in the pipe 7 is kept at a constant temperature higher than a temperature in the bomb 1 or such that the temperature in the pipe 7 and the bomb 1 is kept at a constant temperature higher than the ambient temperature.

In this conventional gas supply apparatus, the following problems are posed during installation and maintenance of a gas pipe. Since an entire gas pipe extending from the gas supply apparatus to a vacuum device main body must be wound by a heater wire, installation and maintenance costs are increased. In addition, since the temperature of the long pipe must always be controlled to be constant, a temperature abnormality monitoring system must be mounted, thereby complicating routine management.

SUMMARY OF THE INVENTION

It is an object of the present invention to provide a gas supply apparatus having low installation and maintenance costs.

It is another object of the present invention to provide a gas supply apparatus in which a special temperature monitoring system is not required, thereby facilitating routine management.

In order to achieve the above objects, according to the present invention, there is provided a gas supply apparatus comprising a bomb filled with liquid gas, a mass flow controller for controlling a flow rate of an evaporated gas supplied from the bomb to supply the liquid gas having a vapor pressure lower than an atmospheric pressure to a vacuum vessel evacuated at a predetermined degree of vacuum through a long pipe, a valve, arranged between the bomb and the mass flow controller, for performing supply/interruption of the gas flowing into the mass flow controller, and heating means for heating the mass flow controller, the valve, and a pipe for connecting the mass flow controller and the valve.

DESCRIPTION OF THE PREFERRED EMBODIMENT

The present invention will be described below with reference to the accompanying drawings.

Figure 1:
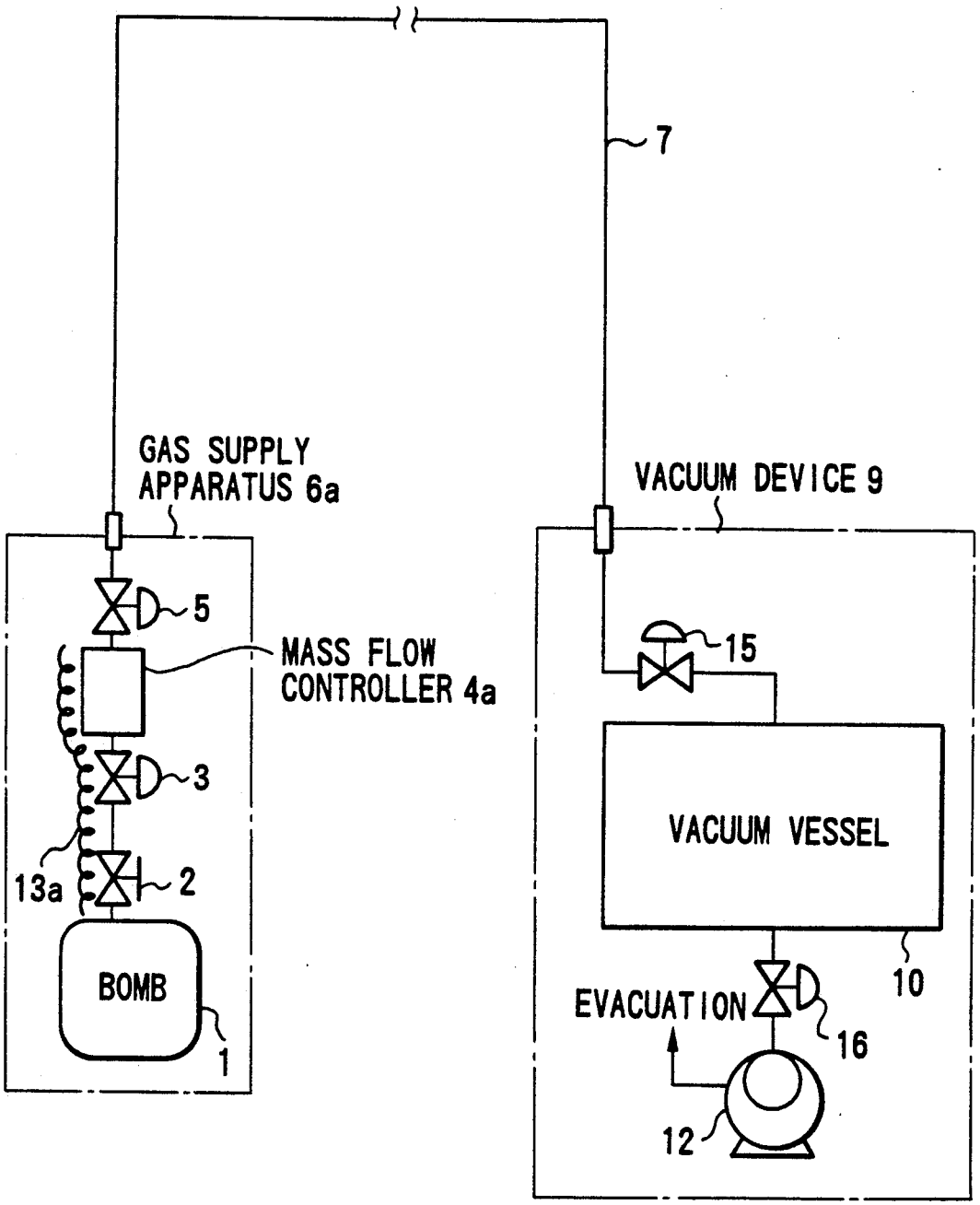
FIG. 1 is a view showing a piping system for explaining a gas supply apparatus according to an embodiment of the present invention.

FIG. 1 shows a piping system for explaining a gas supply apparatus according to an embodiment of the present invention. As shown in FIG. 1, in a gas supply apparatus 6*a*, a first control valve 3, a mass flow controller 4*a*, arranged as in a vacuum device 9 of a conventional apparatus, for automatically controlling a gas flow rate, a second control valve 5, and a heater 13*a* which is wound on a source valve 2, the first control valve 3, the mass flow controller 4*a*, and a pipe for connecting these components to heat these components are arranged at the outlet of the source valve 2 connected to a bomb 1 filled with a liquid gas. A vacuum device 9 connected to the gas supply apparatus 6*a* through a pipe 7 consists of a vacuum vessel 10, a vacuum pump 12, and valves 15 and 16.

Figure 2:
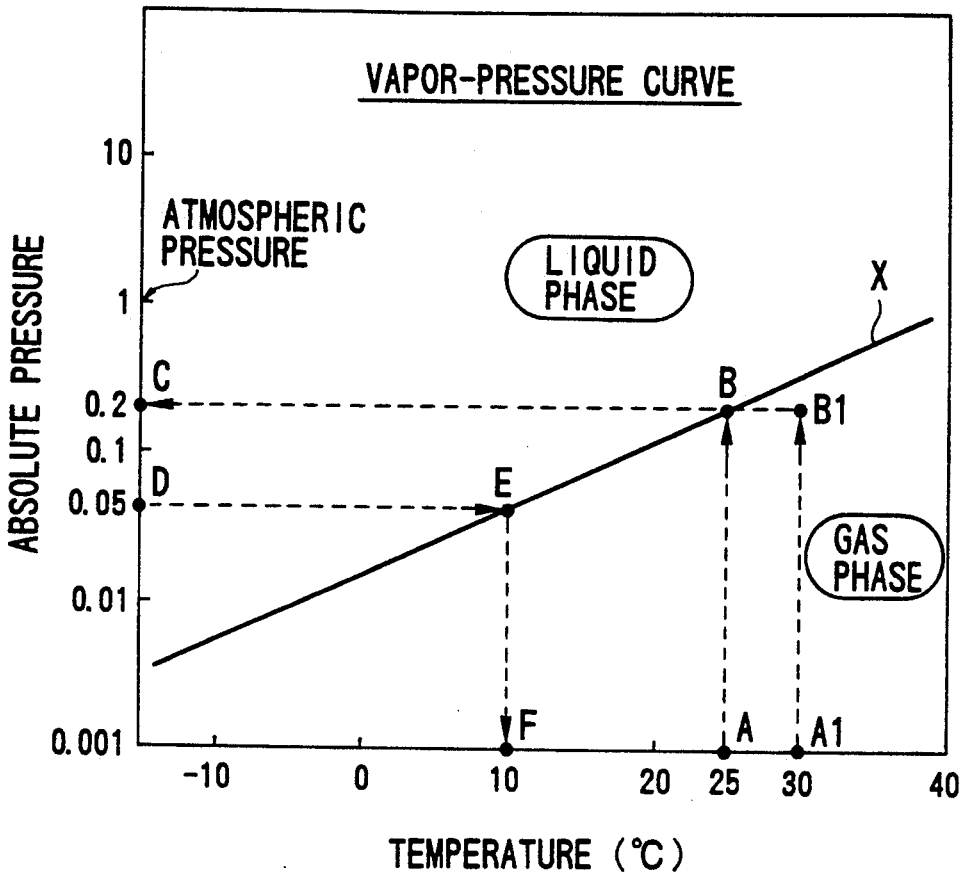
FIG. 2 is a graph showing a vapor-pressure curve of a liquid gas having a vapor pressure higher than the atmospheric pressure.
Figure 3:
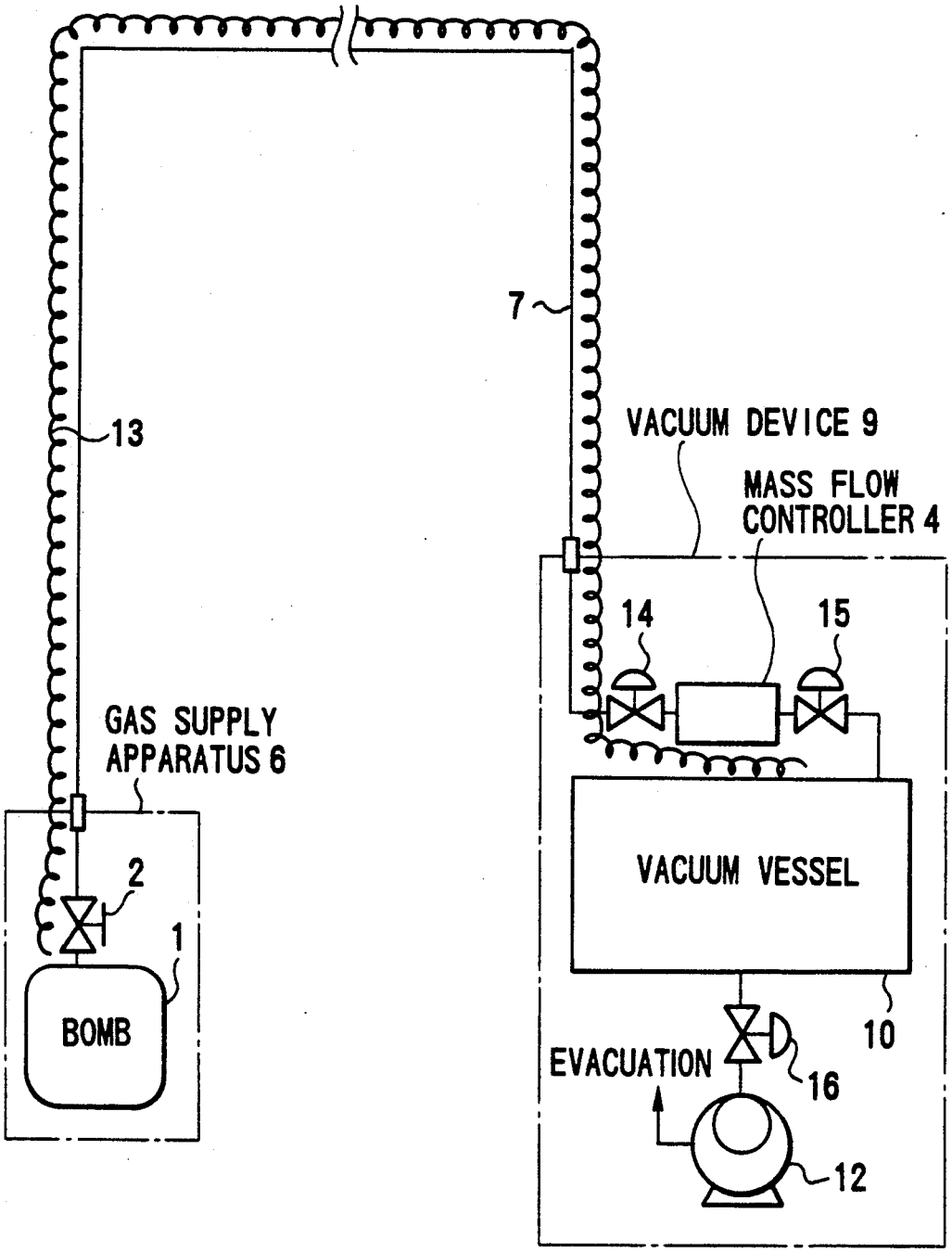
FIG.3 PRIOR ART
FIG. 3 is a view showing a piping system for explaining a conventional gas supply apparatus.

FIG. 2 shows a vapor pressure curve of a liquid gas having a vapor pressure higher than the atmospheric pressure. The operation and function of the gas supply apparatus will be described below. A liquid gas having a vapor-pressure characteristic curve X shown in FIG. 2 is filled in the bomb 1, and the gas flows into the vacuum vessel 10 evacuated by the vacuum pump 12 of the vacuum device 9. In this state, when the ambient temperature and the temperature in the bomb 1 are set to be 25° C., as shown in FIG. 2, the pressure of the gas flowing from the bomb 1 to the mass flow controller 4*a* is 0.2 atm as obtained by A → B → C. In this state, when the temperature of this apparatus is controlled by the heater 13*a* at 30° C., since the point B is shifted to an almost point Bl, the state of the gas flowing from the source valve 2 to the mass flow controller 4*a* is changed from a gas-liquid state to a perfect gas state. In a gas flowing state, the pressure of the outlet side of the mass flow controller 4*a* is lower than that of the inlet side. Therefore, if the pressure of the vacuum device 9 is set to be 0.05 atm, when a liquefying start temperature is observed, as shown in FIG. 2, liquefaction is not started until the temperature is set to be 10° C. or less, as obtained by D → E → F. That is, since the gas in the pipe extending from the mass flow controller 4*a* to the vacuum vessel 10 is set in a perfect gas state, the gas need not be heated. Therefore, in installation of the pipe, the same pipe installation and management as those of a normal high-pressure gas pipe can be used.

Although not shown, if a pipe extending upward is applied as the pipe extending from the bomb 1 to the mass flow controller 4*a*, the heater 13*a* may be omitted. In this case, even if the gas is liquefied, since the liquid gas flows into the gas bomb 1 due to its weight, the liquid gas rarely clogs the pipe.

As described above, the mass flow controller 4*a* for controlling a flow rate is arranged on the gas supply apparatus side, and the temperature of the gas supplied from the valve and the mass flow controller 4*a* is set to be room temperature. In this state, the pressure in the pipe 7 extending from the mass flow controller 4*a* to the vacuum vessel 10 is close to but slightly lower than the pressure of the vacuum vessel 10. Even when the temperature in the pipe is decreased, the gas is not liquefied. In this embodiment, although the heater is wound as a heating means, an air conditioner may be arranged in a chamber for incorporating the gas supply apparatus to keep the ambient temperature of the gas supply apparatus to be room temperature.

As described above according to the present invention, since a mass flow controller for controlling a flow rate is connected to a gas supply bomb to allow the gas to be supplied to a long pipe at a low pressure, even when the temperature in the pipe is decreased, the gas is not liquefied. Therefore, a gas supply apparatus having the following effects can be obtained. That is, the long pipe need not be wound with a heater, routine maintenance can be easily performed, and installation can be performed at low cost.

What is claimed is:

1. A gas supply apparatus comprising:

a bomb filled with a liquid gas;

a mass flow controller connected immediately after said bomb via an internal pipe leading to a vacuum vessel, said mass flow controller controlling a flow rate of a gas obtained by evaporating the liquid gas from said bomb in order to supply the gas at a vapor pressure which is lower than atmospheric pressure to said vacuum vessel which is evacuated to a predetermined degree of vacuum through an external pipe, the gas being sent through said external pipe at a pressure which is lower than said vapor pressure;

a valve, arranged between said bomb and said mass flow controller, for performing a supply/interruption of the gas flowing into said mass flow controller; and heating means for heating said mass flow controller, said valve, and at least a portion of said internal pipe between said mass flow controller and said valve.

2. An apparatus according to claim 1, wherein said valve includes a source valve for performing supply/interruption of the gas from said bomb and a control valve arranged on a gas inlet side of said mass flow controller, and and means heats a pipe for connecting said mass flow controller, said control valve, and said source valve.

3. An apparatus according top claim 1, wherein said pipe for connecting said bomb, said valve, and said mass flow controller is a pipe extending in an upward direction.

4. An apparatus according top claim 1, wherein said heating means is a heater winding on said mass flow controller, on said valve, and on said pipe for connecting said mass flow controller and said valve.

5. A gas supply system comprising:

a gas supply apparatus including a bomb filled with a liquid gas, a mass flow controller which is connected to an internal pipe at a point which is just after said bomb, said mass flow controller controlling a flow rate of a gas obtained by evaporating the liquid gas in said bomb in order to supply the gas at a vapor pressure which is lower than atmospheric pressure, a valve arranged between said bomb and said mass flow controller, said valve performing a supply/interruption of the gas flowing into said mass flow controller, and heating means for heating said mass flow controller, said valve and at least a portion of said internal pipe between said mass flow controller and said valve, the gas being sent to an external pipe at a pressure which is lower than said vapor pressure, a vacuum device connected to said gas supply apparatus, said vacuum device including a vacuum pump and a vacuum vessel evacuated at a predetermined pressure by said vacuum pump; and said external pipe being connected between said gas supply apparatus and said vacuum device for sending the gas from said mass flow controller to said vacuum vessel at a pressure which is lower than said vapor pressure.

* * * * *